US006094912A

United States Patent [19]

Williford

[11] Patent Number: 6,094,912

[45] Date of Patent: Aug. 1, 2000

[54] APPARATUS AND METHOD FOR ADAPTIVELY CONTROLLING MOVING MEMBERS WITHIN A CLOSED CYCLE THERMAL REGENERATIVE MACHINE

[75] Inventor: Ian Williford, Richland, Wash.

[73] Assignee: Stirling Technology Company, Kennewick, Wash.

[21] Appl. No.: 09/250,127

[22] Filed: Feb. 12, 1999

[51] Int. Cl.[7] ..... F01B 29/10

[52] U.S. Cl. ..... 60/520; 60/522; 60/517

[58] Field of Search ..... 60/517, 520, 521, 60/522

[56] References Cited

U.S. PATENT DOCUMENTS

| | | | |
|---|---|---|---|
| 4,369,398 | 1/1983 | Lowry, Sr. | 318/114 |
| 4,413,950 | 11/1983 | Wiernicki | 417/53 |
| 4,433,279 | 2/1984 | Bhate | 322/3 |
| 4,642,547 | 2/1987 | Redlich | 322/3 |
| 4,646,014 | 2/1987 | Eulenberg | 324/251 |
| 4,739,264 | 4/1988 | Kamiya et al. | 324/251 |
| 4,778,353 | 10/1988 | Wiernicki | 417/53 |
| 4,808,918 | 2/1989 | Rozman | 324/142 |
| 4,856,280 | 8/1989 | Chagnot | 60/520 X |
| 4,857,842 | 8/1989 | Sturman et al. | 324/225 |
| 4,875,011 | 10/1989 | Namiki et al. | 324/251 |
| 4,907,435 | 3/1990 | Schulze | 72/21 |
| 4,994,731 | 2/1991 | Sanner | 323/368 |
| 5,028,868 | 7/1991 | Murata et al. | 324/207.2 |
| 5,260,614 | 11/1993 | Theus et al. | 307/491 |
| 5,315,190 | 5/1994 | Nasar | 310/12 |
| 5,385,021 | 1/1995 | Beale | 60/520 X |
| 5,522,214 | 6/1996 | Beckett et al. | 60/517 |
| 5,537,820 | 7/1996 | Beale | 60/520 X |
| 5,582,013 | 12/1996 | Neufeld | 60/520 X |
| 5,642,618 | 7/1997 | Penswick | 60/520 |
| 5,654,951 | 8/1997 | Hoover et al. | 369/97 |
| 5,743,091 | 4/1998 | Penswick et al. | 60/517 |

*Primary Examiner*—Hoang Nguyen
*Attorney, Agent, or Firm*—Wells, St. John, Roberts, Gregory & Matkin, P.S.

[57] ABSTRACT

An apparatus and method are provided for adaptively controlling a closed-cycle thermal regenerative machine. The apparatus includes a housing having at least one chamber for containing a thermodynamic working gas, a linear motor associated with the housing, and a first moving member carried by the linear motor for axial reciprocation within the housing. A second moving member is carried for axial reciprocation within the housing and communicates with the first moving member via the contained thermodynamic working gas. Also included are a pair of permanent magnets, one magnet carried by each moving member; a pair of Hall-effect sensors, one sensor carried by the housing proximate each of the magnets and operative to detect axial displacement amplitude of the proximate reciprocating magnet and moving member. A power supply is coupled to the linear motor and is operative to deliver operating power to the linear motor. Control circuitry is coupled with the Hall-effect sensors and the power supply and is operative to regulate delivery of operating power from the power supply to the linear motor responsive to detected axial displacement amplitude of at least one of the moving members via at least one of the Hall-effect sensors.

33 Claims, 4 Drawing Sheets

APPARATUS AND METHOD FOR ADAPTIVELY CONTROLLING MOVING MEMBERS WITHIN A CLOSED CYCLE THERMAL REGENERATIVE MACHINE

TECHNICAL FIELD

This invention relates to monitoring and/or controlling the position of a machine component, and more particularly to apparatus and methods for detecting and controlling reciprocating/vibrating components present within power conversion machinery; for example, internally mounted displacer and piston assemblies for use in power conversion machinery, such as a compressor, an engine, a heat pump, or a Stirling cycle cryogenic cooler.

BACKGROUND OF THE INVENTION

In the past, it has been desirable to determine the positioning of moving parts within a machine. For example, it has been desirable to determine the position of pistons within hydraulic/pneumatic actuators. However, such machines often require that positioning of the piston be detected without actually touching the piston, as the piston is moving during operation. In a hydraulic/pneumatic machine where a pressure vessel contains a moving piston, the placement of a sensor that extends through the pressure vessel walls can lead to leakage and a loss of operating pressure. Such leakage and loss of operating pressure can lead to a significant loss in effective operating life and efficiency.

One type of positioning apparatus for determining the position of a moving part within a machine is described in U.S. Pat. No. 4,369,398 which discloses an apparatus for monitoring vibrating equipment. Hall-effect switches are used to detect movement of a magnet on vibrating equipment that can result in overstroke or understroke. A control circuit is operable responsive to detected overstroke from the overstroke Hall-effect switch to generate an alarm and/or shut down the vibrating equipment. However, a pendulum member is used to detect when vibrating equipment undergoes oscillatory motion having an excess of amplitude, and a control circuit is used to shut the equipment down when the vibration is greater than a predetermined normal range. Accordingly, such pendulum only indirectly measures overstroke of the vibrating equipment, and other external vibration sources can induce movement of the pendulum member.

Another type of positioning apparatus for determining the position of a moving part within a machine is described in U.S. Pat. No. 4,907,435, which discloses a Hall-effect proximity switch that is positioned to cooperate with a switching arm that is driven rotatably by movement of an adjusting valve. The Hall-effect proximity switch detects motion of a rotating machine component having a slot therein for enabling control of a hydraulic valve type of positioning apparatus for determining the position of a moving part within a machine. However, the switching arm is driven in rotation and does not provide an efficient solution for monitoring the movement of purely reciprocating machine components.

Yet another type of positioning apparatus for determining the position of a moving part within a machine is described in U.S. Pat. No. 4,857,842, which discloses a temperature compensated Hall-effect position sensor. Such sensor can be used with hydraulic and pneumatic actuators having a magnetic piston and a non-magnetic cylinder. A pair of Hall-effect sensors are mounted adjacent a permanent magnet positioned on an outside of a hydraulic cylinder. The sensors are positioned upside-down relative to one another such that they perceive equal and opposite magnetic fields. Output signals are amplified and inverted, then added together. Such summing process cancels out any temperature-induced variations in the voltage output signals. As the piston approaches the position sensor, the magnetic field at the sensors rises from magnetic piston material forming a flux path between the magnet and the Hall-effect sensors. Hence, arrival of the piston at the piston sensor location can be determined. However, the cylinder must be non-magnetic. Furthermore, two separate Hall devices are needed in order to compensate for temperature effects. Even furthermore, a comparator is required for controlling operation of an external device depending on the position of an object with respect to the Hall-effect devices.

A similar problem of detecting and controlling moving member displacement amplitude is encountered with axially reciprocating displacers and pistons in power conversion machinery, such as Stirling cycle machines. However, a typical Stirling cycle machine includes a pressure vessel that houses a reciprocating displacer and a reciprocating piston and contains a thermodynamic working gas. A typical displacer forms a piston-type device that is movably carried within the housing. Reciprocating movement of the displacer within a chamber of the housing transfers working fluid between the front and back sides of the displacer, causing a thermodynamic transformation therebetween. Movement of the displacer occurs between a compression space, having a temperature somewhat above ambient, and an expansion space, having a low temperature (when configured in a cooler) or high temperature (when configured in an engine).

When configured as a Stirling cryocooler, an end portion of a reciprocating displacer forms a drive area in fluid contact with the compression space. The displacer end portion slidably extends through a bore in the housing in fluid communication with a compression space of a linear drive motor. The drive motor has a driving piston that operates on working gas in the compression chamber. The working gas then directly works on the displacer to produce motion. Hence, the driving piston and displacer form a free-piston machine, cooperating solely by action of the working fluid. A clearance seal is typically provided between the displacer end portion and the housing bore by maintaining an accurate reciprocating motion of the displacer and by providing an accurate relative sizing of the bore in the housing with the working piston and displacer end portion. The expansion space draws heat from a surrounding cold head, imparting cooling there along. The same construction can form a Stirling engine, by simply imparting heat to the cold head, causing the displacer to reciprocate, and moving the linear drive motor (which now operates as a linear alternator) to produce electric power.

For the case of a Stirling cycle machine, there exists a need to accurately monitor the position of both the linear drive motor piston and the displacer piston. Furthermore, there exists a need to more accurately control moving member displacement amplitude in Stirling cycle machines.

According to one construction technique used by Applicant, a displacer is supported within a chamber of a pressure vessel housing in a sprung configuration for Stirling cycle power conversion machinery. The sprung configuration includes a pair of flexural bearing assemblies that are used to accurately position a reciprocating member in a housing with respect to a clearance seal. Details of one such construction are disclosed in Applicant's U.S. Pat. No. 5,642,618. This U.S. Pat. No. 5,642,618 is herein incorporated by reference. However, further improvements are needed to enhance the monitoring and control of moving parts within such closed-cycle thermodynamic machines.

Therefore, there is a need to provide an improved moving member detector and control system for a Stirling cycle machine. More particularly, there exists a need to provide for a moving member detector that accurately and economically detects moving members within a pressure vessel containing thermodynamic working gas in an accurate, relatively efficient, and cost-effective manner. Even furthermore, there is a need to control movement of moving members within such a closed-cycle thermodynamic machine based upon detected positioning of the moving members and/or operating parameters generated by the thermodynamic machine. For example, there exists a need to provide for a control system for a Stirling cycle cryocooler wherein a realized temperature at a cold head is utilized to regulate operation of the cryocooler. The present invention also arose from an effort to develop such an improved construction in a simplified, economical, and cost effective manner.

SUMMARY OF THE INVENTION

A control system is provided for free-piston thermal engines and refrigerators which allows moving members such as pistons and displacers to operate at substantially full amplitude displacements for a number of operating environments. For example, free-piston thermodynamic gas cycle refrigerators or engines have two moving components, a piston and a displacer. The displacement amplitude of each moving component is controlled so as to enable full amplitude displacements that correspond to a desirable operating condition, but while preventing overstroke conditions of either component or member.

Accordingly, a control system is provided for a free-piston Stirling cycle refrigerator as described below, which allows a piston or displacer to operate at full amplitude. At the same time, overstroke of either component is prevented during the full range of operating conditions, such as from start-up to normal operating conditions. Furthermore, a cryocooler embodiment uses a temperature sensor to generate a control signal for controlling operation of the cryocooler based upon the realized temperature achieved at a cold head of the cryocooler.

According to one aspect of this invention, an apparatus is provided for adaptively controlling a closed-cycle thermal regenerative machine and includes a housing having at least one chamber for containing a thermodynamic working gas, a linear motor associated with the housing, and a first moving member carried by the linear motor for axial reciprocation within the housing. A second moving member is carried for axial reciprocation within the housing and communicates with the first moving member via the contained thermodynamic working gas. Also included are a pair of permanent magnets, one magnet carried by each moving member. Additionally, a pair of Hall-effect sensors are provided, one sensor carried by the housing proximate each of the magnets and operative to detect axial displacement amplitude of the proximate reciprocating magnet and moving member. A power supply is coupled to the linear motor and is operative to deliver operating power to the linear motor. Control circuitry is coupled with the Hall-effect sensors and the power supply and is operative to regulate delivery of operating power from the power supply to the linear motor responsive to detected axial displacement amplitude of at least one of the moving members via at least one of the Hall-effect sensors.

According to another aspect of this invention, a cooler control system includes a housing, a compressor, a displacer, a magnet, a Hall-effect sensor, a power supply and control circuitry. The housing encases a compression chamber and an expansion chamber provided in fluid communication therebetween and configured to contain a thermodynamic working gas. The compressor is carried by the housing and has a linear motor and a piston. The piston is supported for axial reciprocation in fluid communication with the compression chamber. The displacer is carried for axial reciprocation within the housing in fluid communication with the compression chamber at a first end and the expansion chamber at a second end. The displacer is supported for movement in fluid communication with the piston via the thermodynamic working gas such that the displacer moves in axial reciprocation responsive to movement of the piston. The magnet is carried for movement within the housing in combination with at least one of the piston and the displacer. The Hall-effect sensor is carried by the housing in proximity with the magnet and operative to generate an output signal associated with displacement amplitude of the at least one of the piston and the displacer within the housing. The power supply is configured to deliver operating power to the compressor. Finally, the control circuitry is coupled with the Hall-effect sensor and the power supply and is configured to deliver operating power to the compressor responsive to the detected displacement amplitude of the at least one of the piston and the displacer.

According to yet another aspect of this invention, a Stirling cycle cryogenic cooler includes a compressor, a displacer assembly, a magnet, a Hall-effect sensor, a power supply and a controller. The compressor has a linear drive motor and a piston supported for reciprocation by the drive motor. The displacer assembly has a displacer supported for reciprocation. The displacer cooperates with the compressor to contain a thermodynamic working gas. The magnet is carried for movement in combination with at least one of the piston and the displacer. The Hall-effect sensor is carried by one of the compressor and the displacer assembly in signal communication with the magnet. The sensor is operative to generate an output signal indicative of displacement of the magnet. The power supply is usable to deliver operating power to the linear drive motor. The controller is signal coupled with the sensor and the power supply, and is configured to receive the output signal from the Hall-effect sensor. The controller is operative to regulate delivery of operating power to the power supply so as to regulate amplitude displacement of the at least one of the piston and the displacer.

According to even another aspect of this invention, a method is disclosed for adaptively controlling moving members within a closed cycle thermodynamic machine. The machine has at least two moving members that include a piston assembly and a displacer assembly that cooperate to contain a thermodynamic working gas. The piston assembly includes a drive piston, and the displacer assembly includes a displacer. The drive piston and the displacer are supported for axial reciprocation within the machine, and in communication with the working gas. The method includes the steps of: carrying a magnet for reciprocating movement with one of the drive piston and the displacer; delivering operating power to the machine so as to impart reciprocation to the drive piston and the displacer; detecting movement of the magnet with a Hall-effect sensor; and adjusting the level of operating power delivered to the machine in response to the detected movement of the magnet so as to control amplitude displacement of the one of the drive piston and the displacer.

BRIEF DESCRIPTION OF THE DRAWINGS

Preferred embodiments of the invention are described with reference to the accompanying drawings, which are briefly described below.

DETAILED DESCRIPTION OF THE PREFERRED EMBODIMENTS

Figure 1:
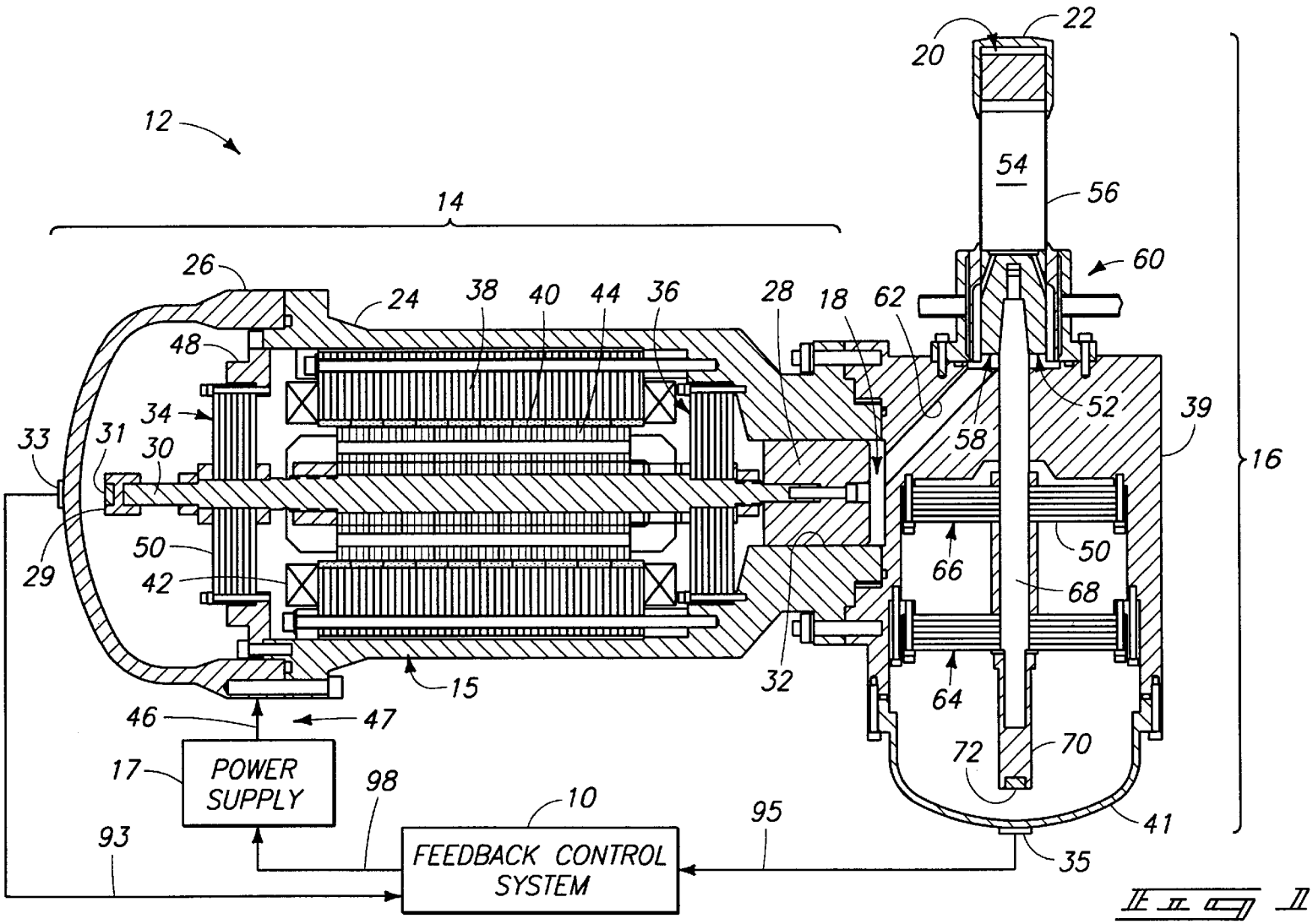
FIG. 1 is a vertical sectional view of a Stirling Cycle cryogenic cooler having a pair of switching Hall-effect sensors configured to detect displacer and power piston movement, and a control system, embodying this invention.

This disclosure of the invention is submitted in furtherance of the constitutional purposes of the U.S. Patent Laws "to promote the progress of science and useful arts" (Article 1, Section 8).

For purposes of teaching Applicant's invention, basic elements of the invention are described for use in measuring/controlling displacement of moving members with reference to conventional components of an integral, free-piston Stirling cycle refrigerator or generator. However, it is understood that the inventive features disclosed herein can also be applied to other linear reciprocating members used within power conversion machinery, such as any configuration of a Stirling engine, a fluid compressor, a pump, a linear alternator or generator, and other thermodynamic cycle devices which require linear reciprocation of a displacer and/or piston, such as the expander portion of a Gifford McMahon cooling machine.

According to one version of Applicant's invention, a free-piston Stirling cycle refrigerator comprises moving members that are driven in operation by a linear motor in order to perform thermodynamic gas cycle work. The linear motor forms the driving motor of a compressor, operative to drive a moving member that includes a piston. The piston is moved in reciprocation to compress working gases that in turn move a displacer in reciprocation. On the one hand, over-stroking of either moving member, the piston and the displacer, can cause damage to the machine and result in degradation in performance. On the other hand, under-stroking of the piston and displacer limits the performance of the machine, by not allowing the machine to operate at maximum capacity.

To further compound the design problem, the cooler is warm during normal start-up of the refrigerator, which results in the displacer having a greater amplitude than under steady state run conditions. Hence, the displacement amplitude of the displacer limits the maximum power applied to the cooler. After a period of operation, the temperature of the cold end decreases, such that the displacer amplitude decreases and eventually the compressor piston amplitude limits the maximum power applied to the machine. For a properly tuned machine, the compressor and displacer move at full amplitude when the machine is at design operating conditions. By varying the power being applied to the linear motor, the amplitude of the moving members can be controlled so as to realize optimal design operating conditions.

For the case where Applicant's invention is implemented on an engine, such as a Stirling engine, overstroke and/or understroke conditions for moving members can be detected. In this case, control circuitry is operable to regulate amplitude displacement of such moving members by regulating heat generated by a burner of the Stirling engine responsive to the detected moving member amplitude displacement. Accordingly, amplitude displacement of a displacer and a compressor piston for a linear alternator is monitored. Control circuitry receives such monitored output signals and generates a control signal for regulating operation of a burner coupled to the heater head of the engine. In this embodiment, the linear alternator comprises a piston assembly including a drive piston.

A preferred embodiment of the invention is illustrated in the accompanying drawings particularly showing a feedback control system generally designated with reference numeral 10 in FIGS. 1–4. As shown in FIGS. 1–4, feedback control system 10 is implemented on a Stirling cycle cryogenic cooler 12. Feedback control system 10 monitors the movement of two distinct moving components within cooler 12 via a pair of temperature compensated switching Hall-effect sensors 33 and 35. Cooler 12 is formed from a compressor 14 and a displacer assembly 16. Compressor 14 includes a linear drive motor 15 and a piston 28. In operation, feedback control system 10 monitors the movement of two distinct groups of moving members or components; namely, piston 28 and a piston rod 30 within compressor 14, and a displacer 52 and a displacer rod 68 of displacer assembly 16. Feedback control system 10 regulates input power 46 delivered to motor 15 of compressor 14 via power supply 17. Such regulated input power 46 is operative to control the operating speed of cooler 12 based upon the detected movement of one or both of such components within cooler 12.

Cryogenic cooler 12 is formed by assembling together a compressor 14, that includes linear drive motor 15 and a separate displacer assembly 16. Cooler 12 is a thermal regenerative machine configured in operation to house a gaseous working fluid, usually contained under pressure. Linear drive motor 15 is formed by a piston assembly that operates to alternately compress and expand working fluid present within a compression chamber (hot space) 18 that is in fluid communication via a fluid flow path with an expansion chamber (cold space) 20. A portion of the working fluid within expansion chamber 20 cools an end cap 22 of displacer assembly 16 each time the working fluid is expanded. Flat spiral springs are used in the form of flexure bearing assemblies 34, 36 and 64, 66 to movably support the axially reciprocating internal working components of compressor 14 and displacer assembly 16, respectively, as will be discussed below.

With the exception of the below-mentioned novel feedback control system 10, switching Hall-effect sensors 33 and 35 and temperature sensor 86 (of FIG. 3), a Stirling cycle machine similar to Stirling cooler 12 is disclosed in Applicant's U.S. Pat. No. 5,642,618, entitled "Combination Gas and Flexure Spring Construction for Free-Piston Devices", listing the inventor as Laurence B. Penswick. This U.S. Pat. No. 5,642,618 is hereby incorporated by reference as evidencing the presently understood construction of such a machine.

As shown in FIG. 1, compressor 14 has a motor housing 24 that contains linear drive motor 15 and cooperates in assembly with an end cap 26 to form a first pressure vessel structure. The housing 24 and end cap 26 form an inner chamber in which piston 28 is supported on piston rod 30 for reciprocation within a piston bore 32. Bore 32 is constructed and arranged to receive piston 28 in non-contact and reciprocating relation therein, via the associated pair of flexure bearing assemblies 34 and 36.

As shown in FIG. 1, piston 28 is driven in axial reciprocation within bore 32 by way of an electric motor formed by linear motor 15. Piston 28 acts on, or drives, the working fluid within compression chamber 18 and expansion chamber 20 via a fluid flow path formed therebetween. Any of a number of presently known fluid flow path constructions can be used to transfer working gases between compression chamber 18 and expansion chamber 20.

Further construction details of one suitable form of linear drive motor 15 are disclosed in Applicant's U.S. Pat. No. 5,315,190, entitled "Linear Electrodynamic Machine and Method of Using Same", herein incorporated by reference as evidencing the state of the art. However, other constructions for a linear drive motor can be used in the alternative.

According to the construction depicted in FIG. 1, an array of individual stationary iron laminations 38 are secured via a plurality of fasteners within housing 24. The stationary laminations 38 form a plurality of spaced apart and radially extending stationary outer stator lamination sets that cooperate to define a plurality of stator poles, winding slots, and magnetic receiving slots. An array of annular shaped magnets 40 are bonded to the inner diameter of stationary laminations 38 for the purpose of producing magnetic flux. Each magnet 40 is received and mounted within the plurality of magnet receiving slots. Furthermore, each of the magnets has an axial polarity, and copper coils 42 are placed in slots surrounding the magnets.

As shown in FIG. 1, an array of moving iron laminations 44 are secured to shaft 30, such that the shaft and laminations move in reciprocation along with piston 28. A plurality of threaded fasteners are received through radially spaced apart through-holes in each lamination 44, trapping the laminations 44 between a pair of retaining collars carried on shaft 30. One collar is axially secured onto shaft 30 with threads where it also seats against a shoulder on shaft 30. Relative motion between moving laminations 44 and stationary laminations 38 is produced by applying electrical power, or alternating current 46, to the coils 42 by way of an electrical power supply cord 47 that extends through a pressure sealed power feed (not shown) formed in housing 24. To facilitate assembly of compressor 14, a mounting ring 48 is used to support shaft 30 by means of flexure bearing assembly 34 opposite from piston 28. A plurality of threaded fasteners are used to retain ring 48 to housing 24.

A suitable flexure 50 for use in flexure assemblies 34 and 36 is disclosed in Applicant's U.S. patent application Ser. No. 08/105,156, filed on Jul. 30, 1993 and entitled "Improved Flexure Bearing Support, With Particular Application to Stirling Machines", listing the inventor as Carl D. Beckett, et. al. This Ser. No. 08/105,156 application, which is now U.S. Pat. No. 5,522,214, is hereby incorporated by reference.

Also shown in FIG. 1, displacer 52 is carried for movement within displacer assembly 16 on displacer rod 68 by another pair of flexure bearing assemblies 64 and 66. Flexure bearing assemblies 64 and 66 are similar to assemblies 34 and 36, each being formed from a plurality of flat spiral flexures, or springs, 50. Displacer 52 reciprocates so as to move the working fluid between chambers 18 and 20 pursuant to a Stirling thermodynamic refrigeration cycle. As a result, cold head 22 draws away heat from the surrounding environment along the associated end of cooler 12. Cold head 22 is secured to a tube 56 extending from a housing 39. Housing 39 cooperates with an end cap 41 and compressor 14 to form a pressure vessel. In order to enhance thermodynamic efficiency of displacer assembly 16, a regenerator 54 is also provided in-line and in fluid communication with the fluid flow path extending between compression chamber 18 and expansion chamber 20.

Displacer 52 is carried for reciprocation within a tube 56 in coaxial relation therein, so as to provide a clearance seal 58 therebetween. Fluid communicates between compression chamber 18 and expansion chamber 20 via a delivery port 62 and gas passages provided in association with displacer 52 of displacer assembly 16. In this manner, working gases pass between regenerator 54 and compression chamber 18. A fluid flow path is also provided generally between opposite ends of displacer 52 by way of ports, regenerator 54, delivery port 62 and associated fluid passages. Pressure variations at port 62 produced by motor 15 cause the sprung motion of displacer 52 within tube 56, which causes the transfer of working gases therethrough. As a result, working gas is transferred between the compression chamber 18, via delivery port 62, the regenerator 54, and a fluid flow path extending between regenerator 54 and expansion chamber 20.

A heat rejector 60 is also implemented on displacer assembly 16 to improve the thermodynamic efficiency. Heat rejector 60 has an inner wall and an outer wall between which a circumferential fluid cooling cavity is formed. A flow of cooling fluid is passed through the cavity via an inlet and an outlet. Water provides one suitable cooling fluid. Various alternative thermally conductive fluids can also be used, including thermally conductive gases.

As shown in FIG. 1, displacer 52 is carried for axial reciprocation within tube 56 and between end cap 22 and housing 39. Similarly, piston 28 is carried for axial reciprocation within housing 24, and adjacent housing 39. Accordingly, it is desirable to prevent overstroke of piston 28 and displacer 52. For example, overstroke of piston 28 might cause piston 28 to contact housing 39. Similarly, displacer 52 might contact either of end cap 22 or housing 39. Additionally, in order to maintain a relatively high operating efficiency, it is desirable to maximize the displacement of piston 28 and displacer 52 such that more efficient machine operation is realized, while at the same time preventing overstroke.

As shown in FIG. 1, housing 24, end cap 26, housing 39, end cap 41, tube 56 and end cap 22 cooperate to form a pressure vessel for containing working gas under pressure. Switching Hall-effect sensors 33 and 35 are affixed to the outside ends of the pressure vessel at locations that are in proximity with internal moving members. Sensors 33 and 35 are affixed to end caps 26 and 41, respectively, that are formed from non-magnetic material. More particularly, switching Hall-effect sensor 33 is affixed to end cap 26 so as to be provided in signal communication and proximity with, and opposite of, rare earth magnet 31. Magnet 31 is carried by piston rod 30 via a magnet mounting sleeve. Similarly, switching Hall-effect sensor 35 is affixed to end cap 41 so as to be provided in proximity with, and opposite of, rare earth magnet 72. Magnet 72 is affixed to a mounting post 70 carried by displacer rod 68. More particularly, a receptacle is provided within post 70 for securely receiving magnet 72 via a press fit, adhesive mounting, or any equivalent fastening means.

Switching Hall-effect sensors 33 and 35 each generate an output signal 93 and 95, respectively, that is delivered as an input to feedback control system 10. Feedback control system 10 uses such input from signals 93 and 95 to generate an output control signal 98 that is used to control power delivery to motor 15 of compressor 14. Accordingly, power supply 46 delivered from power supply 17 via power cord 47 is controlled such that the amplitude of movement for piston 28 is directly regulated. Additionally, the amplitude of movement for displacer 52 within free-piston cryogenic cooler 12 is indirectly regulated. Hence, input power 46 is delivered from power supply 17 via power cord, or supply line, 47 to linear drive motor 15 of compressor 14 so as to control the maximum displacement of piston 28 and/or displacer 52.

As shown in FIG. 1, sensors 33 and 35 are positioned so as to reduce the need to pierce the pressure vessel that is formed by the housing members of cooler 12. Hence, the likelihood that the housing will develop leaks is reduced. Additionally, the overall complexity of the housing is reduced.

In operation, at maximum operating amplitude for piston 28 an output signal 93 from switching Hall-effect sensor 33 goes high (5 volts DC) as magnet 31 is detected in close proximity. Similarly, at maximum amplitude for displacer 52 an output signal 95 from switching Hall-effect sensor 35 is caused to go high (5 volts DC) as magnet 72 is detected in close proximity. Feedback control system 10 comprises external electronics that are operative to monitor the output signals 93 and 95 from switching Hall-effect sensors 33 and 35, respectively. If neither signal is high, input power 46 to linear drive motor 15 of compressor 14 is incremented until a high signal is detected. When this occurs, input power 46 is dropped until the detected high signal goes low. According to this control scheme implementation, maximum amplitudes for piston 28 and displacer 52 are maintained through the entire cool down phase of cooler 12 without overstroking either component.

As shown in FIG. 1, temperature compensated switching Hall-effect sensors 33 and 35 cooperate with rare earth magnets 31 and 72, respectively, to sense when piston 28 and displacer 68 are at a design limit of amplitude displacement. As will be described below in greater detail, feedback control system 10 includes control circuitry in the form of a controller 76 (see FIG. 2) that receives the output signals 93 and 95 from switching Hall-effect sensors 33 and 35, respectively. Control system 10 converts signals 93 and 95 into a single 0–5 volt control signal 98 that is delivered to variable voltage power supply 17. In return, variable voltage power supply 17 provides the power to drive linear drive motor 15 of compressor 14, for Stirling cycle refrigerator 12.

According to one implementation, switching Hall-effect sensors 33 and 35 each comprise a temperature-compensating switching Hall-effect sensor. One such device is presently sold by Panasonic as a Hall-Effect Sensor Integrated Circuit (IC). Panasonic's Hall IC comprises a combination of a Hall element, an amplifier, a Schmidt trigger, and a stabilized power supply/temperature compensator integrated onto an integrated circuit. Temperature compensation enables stabilization of the temperature characteristics for the sensor. One such Panasonic Hall-effect sensor IC is sold in the United States by Digikey under Model No. DN6848-ND. Such sensors self calibrate for changes in temperature as to impart an accurate measurement of moving members within a cryocooler, irrespective of the operating temperature associated with the cryocooler.

Switching Hall-effect sensors 33 and 35 are each positioned such that magnets 31 and 72, respectively, will cause the respective Hall-effect sensor to switch when the associated moving member is at a design, or full, amplitude, or is in excess of the design amplitude. Both of sensors 33 and 35 are located on the exterior of a pressure vessel that is provided by the housing of cooler 12. According to this implementation, the need for a dedicated access port, or feed-through, extending through the housing to allow passage of sensor electrical feed wires is eliminated when the sensors are mounted to the exterior of the housing. However, end caps 26 and 41 (of FIG. 1) need to be constructed of non-magnetic material, such as aluminum, plastic or fiber-reinforced plastic, in order for sensors 33 and 35 to accurately and efficiently detect magnets 31 and 72, respectively. Hence, a potential leakage path for Stirling cycle working gas is eliminated, and construction of the cooler housing is simplified. Additionally, maintenance checks can be reduced as a potential source of leakage is eliminated. Furthermore, elimination of the feed-through eliminates the extra time and cost of adding and installing a feed-through to the housing.

Alternatively, where the configuration of a compressor or displacer moving member is not conducive to the installation of a Hall-effect sensor on the exterior of a pressure vessel housing, sensors 33 and 35 can be provided within the housing, although some of the above-described benefits are lost. For such cases, the sensors can be installed within the pressure vessel, or housing, with electrical feed-throughs formed through the pressure vessel so as to provide a routing path for the sensor electrical feed wires that extend through the housing and to the control system 10 (of FIG. 1).

As shown in FIG. 1, each sensor 33 and 35 is affixed to a moving member of cooler 12. More particularly, sensor 33 is rigidly affixed directly to piston rod 30, and indirectly affixed to laminations 44 and piston 28. For purposes of this disclosure, rod 30, laminations 44 and piston 28 are individually and jointly considered to provide a moving member, even though only laminations 44 (of FIG. 2) are labeled as a moving member. Similarly, displacer 52, regenerator 54, rod 68 and post 70 are individually and jointly considered to provide another moving member.

Figure 2:
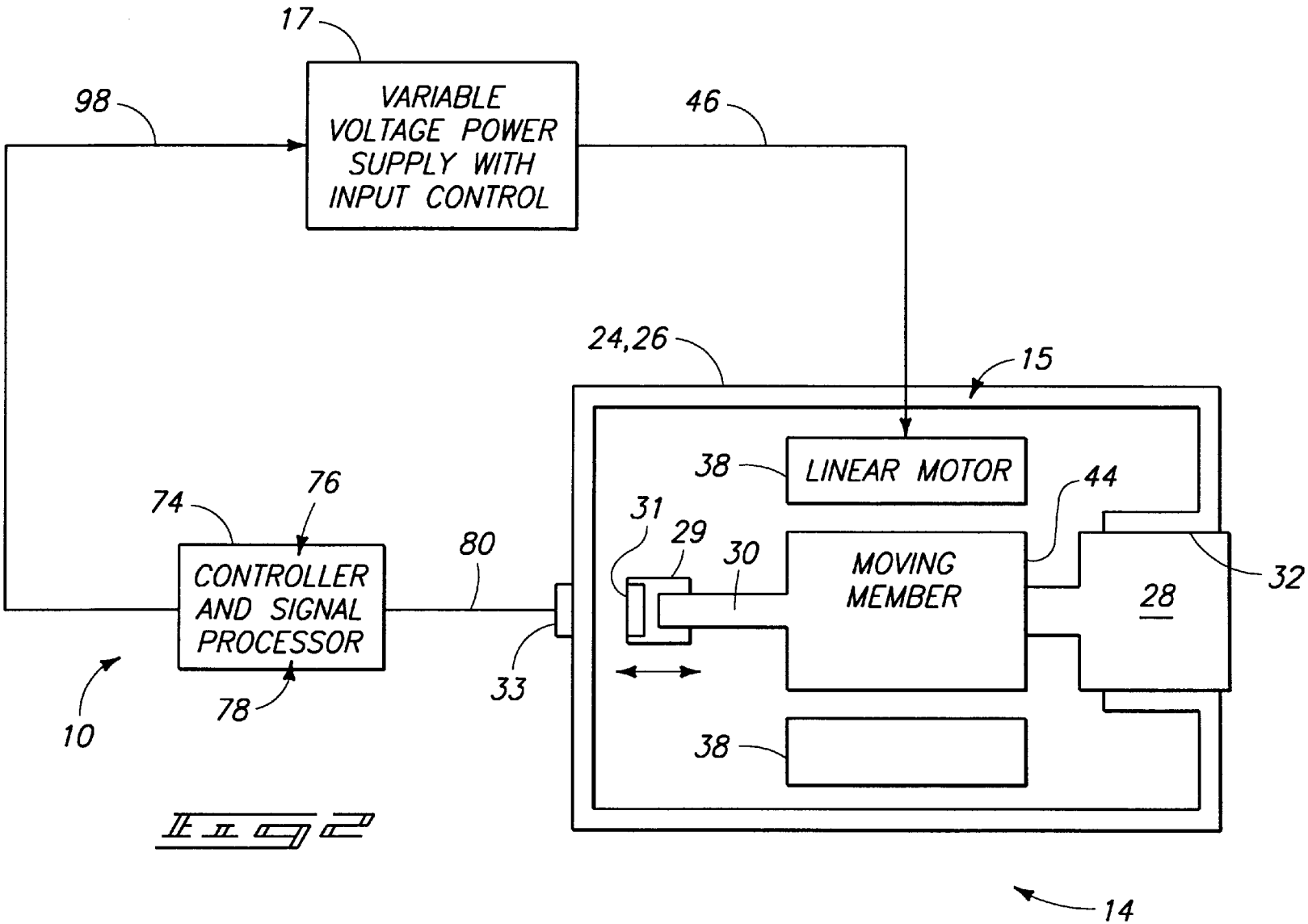
FIG. 2 is a simplified schematic block diagram illustrating control circuitry and a power supply configured for controllably regulating operation of a linear drive motor for the cryogenic cooler of FIG. 1.

FIGS. 1 and 2 together illustrate details of feedback control system 10. As shown in FIG. 1, sensors 33 and 35 and magnets 31 and 72, respectively, are provided in association with the compressor piston 28 and displacer 52 to detect respective displacement amplitudes. Sensor 33 generates an output signal 93 that can be correlated with the displacement of piston 28. Similarly, sensor 35 generates an output signal 95 that can be correlated with the displacement of displacer 52. Output signals 93 and 95 form inputs to feedback control system 10. An output control signal 98 is generated by control system 10, in response to signals 93 and 95, and is delivered to power supply 17. Power supply 17 receives the regulated control signal 98 and generates a regulated supply of power 46 to linear drive motor 15 of compressor 14 via power cord 47. According to one construction, control signal 98 ranges from 0 to 5 volts.

As shown in FIG. 2, feedback control system 10 comprises control circuitry 74 including a controller 74 and a signal processor 78. Control system 10 is operative to monitor output signals 93 and 95 (see FIG. 1) from sensors 33 and 35 for the presence of a high voltage signal (in this case, a 5-volt signal).

If a high voltage signal is not detected from either sensor 33 or sensor 35, control circuitry 74 (and controller 76) increments output control signal 98 to variable voltage power supply 17 which causes an increase in the amplitude of the compressor piston 28 and displacer 52 (of FIG. 1).

Control circuitry 74, and more particularly, controller 76, monitors output signals 93 and 95 for an increase in amplitude. This process is repeated until output signals 93 and/or 95 indicate presence of a high voltage signal from one of Hall-effect sensors 33 and 35, respectively. When such a high voltage signal is detected, controller 76 decreases the 0- to 5-volt control signal 98 to variable voltage power supply 17. Such decrease in control signal 98 causes the amplitude of compressor piston 28 and displacer 52 (of FIG. 1) to decrease commensurately until the high voltage signal from the associated Hall-effect sensor is detected as being eliminated.

Accordingly, the process of monitoring output signals 93 and 95 and controllably regulating the power supply 46 that is output from power supply 17 is repeated in order to operate cooler 12 from a little over to a little under the desired design amplitude. Such an iterative scheme maintains maximum amplitude through a cool down cycle for cooler 12, and furthermore, at certain specified operating conditions. For example, controller 76 is programmed to start from a minimum output voltage control signal 98 when power supply 46 is applied to cooler 12 via power cord 47, or immediately after the occurrence of a power interruption.

Control system 10 includes electronic circuitry usable to perform signal conditioning; namely, additional signal processing circuitry in the form of signal processor 78. As shown in FIG. 1, output signals 93 and 95 from Hall-effect sensors 33 and 35, respectively, are of relatively short duration, on the order of milliseconds. In order to be compatible with relatively slow electronics present within a control system, the pulse-shaped output signals are made longer. In order to make such output signals longer, signal conditioning is performed in order to lengthen the resulting pulse-shaped output signals. In the alternative, a fast response feedback control system can be used such that signal conditioning circuitry will not be needed in order to lengthen such pulse-shaped output signals. However, in certain applications a relatively slow response feedback control system is utilized in an effort to save cost and reduce complexity such that signal conditioning circuitry is combined therewith as discussed below.

More particularly, external electronics in the form of signal conditioning circuitry are used to convert the relatively short pulse from Hall sensor output signals into a relatively long 5-volt DC (VDC) pulse. According to one implementation, signal conditioning circuitry comprises signal processor 78 as shown in FIG. 2. Additionally, external electronics in the form of feedback control system 10 are operative to monitor the relatively long pulse output signal via the signal conditioning circuitry of signal processor 78.

Figure 3:
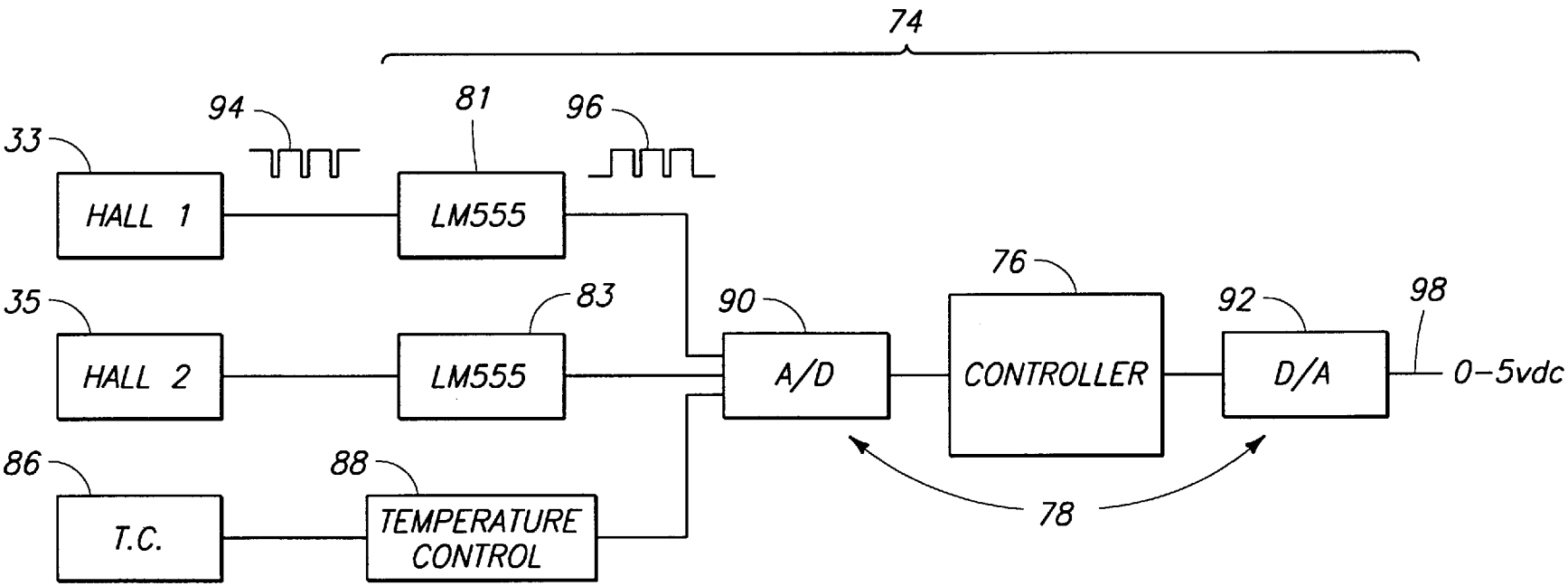
FIG. 3 is a simplified schematic block diagram illustrating in further detail the control circuitry and sensors of FIG. 2.

As shown in FIG. 3, signal processor 78 comprises signal conditioning circuitry that includes a pair of timer chips 81 and 83, an analog-to-digital (A/D) converter 90 and a digital-to-analog (D/A) converter 92. Timer chips 81 and 83 each comprise a monostable multivibrator timer chip such as a model #LM555 chip sold by Motorola or National Semiconductor. Such chips convert relatively short duration output signals 93 and 95 from Hall-effect sensors 33 and 35 to a long pulse that is usable by analog-to-digital (A/D) converter 90 provided within signal processor 78 (of FIG. 2). Additionally, a thermocouple (T.C.) temperature sensor 86 is mounted onto the exterior of the cold head of the cryocooler with adhesive and/or fasteners to provide another control signal for feedback control system 10. Temperature sensor 86 provides an input signal to temperature control circuitry 88.

As shown in FIG. 3, temperature sensor 86 and temperature control circuitry 88 cooperate to generate a control signal indicative of the operating temperature achieved by cryogenic cooler 12 (of FIG. 1). More particularly, temperature sensor 86 is mounted either to the exterior of end cap 22 (of FIG. 1), in close proximity with end cap 22, or even internally of end cap 22. According to one configuration, temperature control circuitry 88 is signal coupled with sensor 86, and is operative to receive a detected sensor signal and generate a temperature control signal. Such temperature control signal is received by A/D converter 90 where it is digitized, then provided to controller 76.

Also according to FIG. 3, A/D converter 90 is configured to change the analog signal from timer chips 81 and 83 into digital signals that form acceptable inputs for controller, or microcontroller, 76. Accordingly, in this operating mode, controller 76 forms a temperature controller that regulates power supply 17 to deliver operating power to linear drive motor 15 (of FIG. 1) based upon the detected temperature at the cold head, or end cap, of the cryogenic cooler. Also according to FIG. 3, A/D converter 90 is configured to change the analog signal from timer chips 81 and 83 into digital signals that form acceptable inputs for controller, or microcontroller, 76.

For the case where sensor 86, control circuitry 88 and controller 76 detect that a desired temperature has been reached, the temperature controller 76 will incrementally decrease the output signal 98 (see FIG. 1) and reduce the power delivered to motor 15 of cooler 12 until the specified temperature is obtained. Hence, the temperature control signal will override the moving member amplitude control signal, and control will be shifted from the amplitude signal of the piston and displacer to the temperature signal. As a result, the controller will toggle about the temperature signal.

As shown in FIG. 3, signals from sensors 33, 35 and 86 are conditioned prior to being received by controller 76. For the case of Hall-effect sensors 33 and 35, timer chips 81 and 83 convert the form of the sensor output signal 94, which has a short pulse output signal, into a conditioned output signal 96, which has a long pulse output signal. Similarly, temperature control circuitry 88 converts the form of a temperature signal received from temperature sensor 86 into a more suitable form usable by controller 76. Furthermore, all three signals are converted from analog form into digital form via A/D converter 90. Controller 76 operates on such signals in digital form, and D/A converter 92 converts a resulting output signal into output voltage control signal 98 that is delivered to power supply 17 (see FIG. 1).

Figure 4:
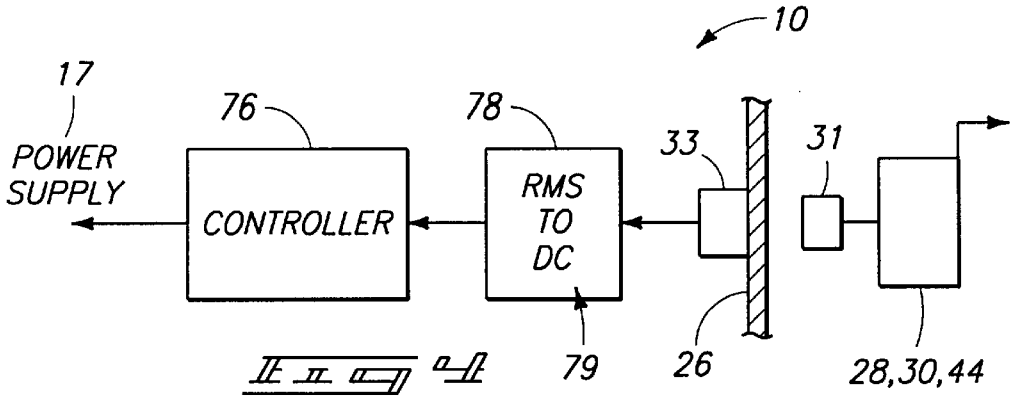
FIG. 4 is a simplified schematic block diagram illustrating the linear drive motor, moving member displacement Hall-effect sensors, a temperature sensor and a controller.

As shown in FIGS. 2–4, in one form controller 76 comprises a microcontroller that receives detected input signals from Hall-effect sensors 33 and 35, and from temperature sensor 86. In one form, temperature sensor 86 comprises a thermocouple temperature sensor. Furthermore, in the embodiment depicted in FIG. 4 signal processor 78 further includes voltage regulating AC/DC circuitry 79 that converts 23 the detected signal from Hall-effect sensors 33 and 35 from RMS to DC.

Controller 76 comprises a preprogrammed integrated circuit, or chip, that is programmed to start from a minimum output and increment to successively higher values with each loop through the operating program depicted below with reference to FIG. 5. Additionally, in the event of a power interruption, controller 76 will not send a signal to the power supply until a start signal is sent to the controller. Then, controller 76 will reset the output increment to zero "0".

Figure 5:
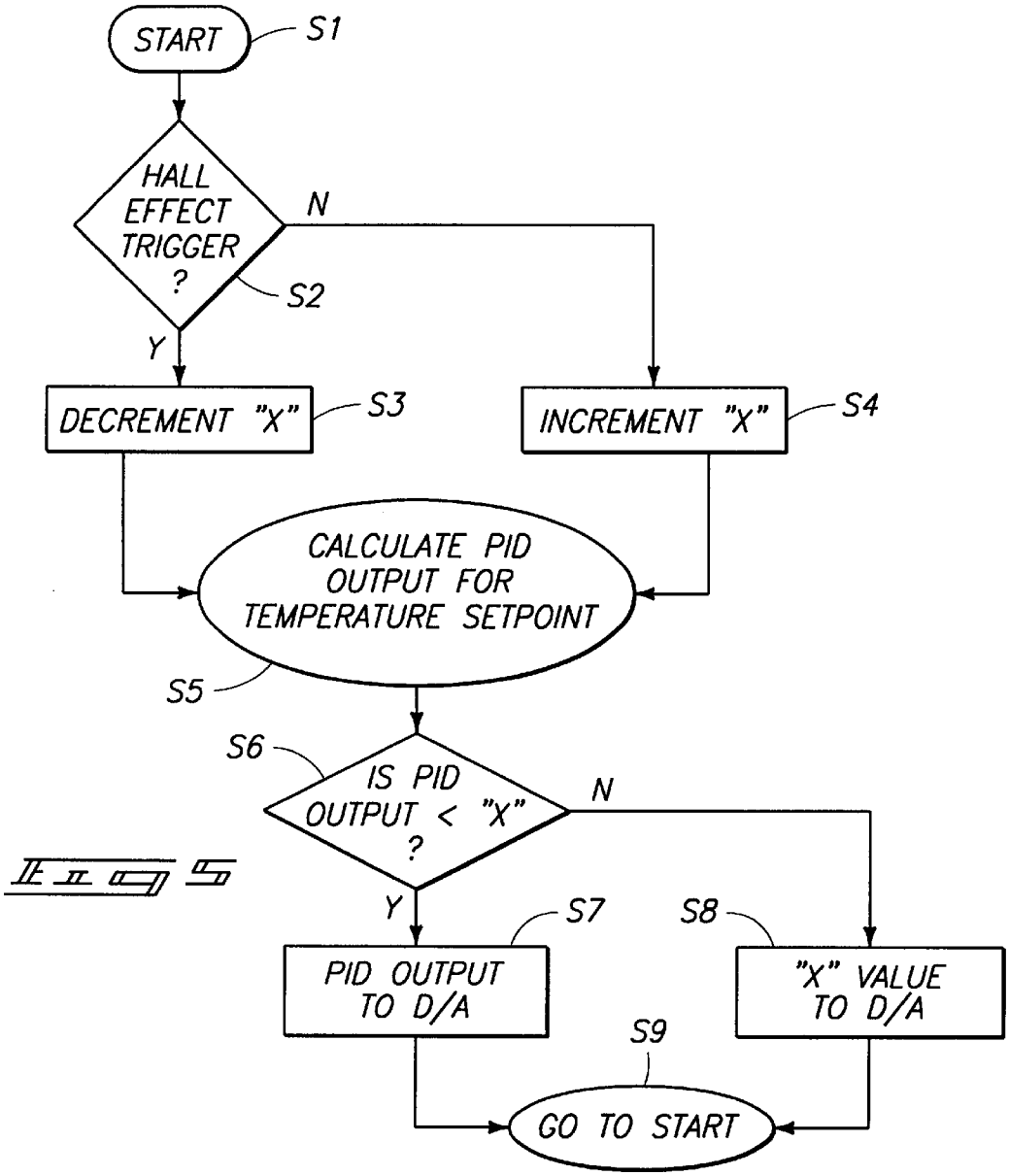
FIG. 5 is a logic flow diagram illustrating operation of the switching Hall-effect sensors and controller of FIGS. 1–4.

As shown in FIG. 5, a logic flow diagram illustrates the steps undertaken by controller 76 to regulate power delivery from the power supply to the motor of the cryocooler of FIG. 1. More particularly, in Step "S1" the process is initiated.

In Step "S2", each Hall-effect sensor is monitored to determine whether the sensor has been triggered by the associated magnet on the moving member. If the sensor has been triggered, the process proceeds to Step "S3". If not, the process proceeds to Step "S4".

In Step "S3", the process decrements the output voltage control signal by a value "X". According to one implementation, "X" equals 0.00122 volts. After performing Step "S3", the process proceeds to Step "S5".

In Step "S4", the process increments the output voltage control signal by the value "X". After performing Step "S4", the process proceeds to Step "S5".

In Step "S5", the process calculates a proportional-integral-differential (PID) output control signal for a temperature setpoint. After performing Step "S5", the process proceeds to Step "S6".

In Step "S6", the process determines whether the PID output is less than "X". If the PID output is determined to be less than "X", the process proceeds to Step "S7". If not, the process proceeds to Step "S8".

In Step "S7", the PID output is delivered to the D/A converter shown in FIG. 3. After performing Step "S7", the process proceeds to Step "S9".

In Step "S8", the process sends the "X" value to the D/A converter. After performing Step "S8", the process proceeds to Step "S9".

In Step "S9", the process completes a full cycle and returns to Step "S1".

Pursuant to implementation of the above-described flowchart, the controller incrementally increases the output signal for each loop of the flowchart until a signal is received from one of the two Hall-effect sensors, or Hall devices. Each loop through the program flowchart of FIG. 5 will cause the output voltage to increase by 0.00122 volts such that a 5-volt range comprises 4,094 iterations. Similarly, when a signal from one of the Hall devices is detected, the program flowchart incrementally decreases the output voltage by one increment, or 0.00122 volts. At this point, the program flowchart will toggle between a high amplitude, where there is a signal received from either Hall-effect sensor, to a low amplitude, where there is no signal received from either Hall-effect sensor.

As shown in FIG. 3, controller 76 then generates an output signal that is converted from a digital signal into an analog signal by D/A converter 92. The converted analog signal is then sent to variable voltage power supply 17 (see FIGS. 1 and 2) as an output signal 98. Output signal 98 ranges from 0 to 5 volts DC.

As shown in FIGS. 1 and 2, variable voltage power supply 17 is used to drive linear motor 15 in a controlled manner. By changing the voltage delivered to motor 15 from 0 to full voltage, the amplitude of the compressor piston and displacer is changed and the cooling capacity of the cooler is also changed. In a typical case, a voltage signal ranging from 0 to 5 volts that is applied to the power supply will control the output from the power supply from minimal to full power. The actual output power and voltage realized will depend on the characteristics and size of the particular cooler.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An apparatus for adaptively controlling a closed-cycle thermal regenerative machine, comprising:

a housing having at least one chamber for containing a thermodynamic working gas;

a linear motor associated with the housing;

a first moving member carried by the linear motor for axial reciprocation within the housing;

a second moving member carried for axial reciprocation within the housing and communicating with the first moving member via the contained thermodynamic working gas;

a pair of permanent magnets, one magnet carried by each moving member;

a pair of Hall-effect sensors, one sensor carried by the housing proximate each of the magnets and operative to detect axial displacement amplitude of the proximate reciprocating magnet and moving member;

a power supply coupled to the linear motor and operative to deliver operating power to the linear motor; and control circuitry coupled with the Hall-effect sensors and the power supply and operative to regulate delivery of operating power from the power supply to the linear motor responsive to detected axial displacement amplitude of at least one of the moving members via at least one of the Hall-effect sensors.

2. The apparatus of claim 1 wherein the first moving member comprises a piston, and wherein the linear motor and the piston cooperate to provide a compressor.

3. The apparatus of claim 2 wherein the second moving member comprises a displacer, and wherein the compressor is operative to impart reciprocation to the piston such that thermodynamic working fluid is moved so as to impart cooperative reciprocating movement to the displacer.

4. The apparatus of claim 1 wherein a portion of the housing is formed from a non-magnetic material, and wherein each Hall-effect sensor is carried externally of the housing in magnetically detectable relation through the non-magnetic housing with the proximate permanent magnet.

5. The apparatus of claim 1 wherein the housing includes an end cap formed from non-magnetic material, and wherein one of the Hall-effect sensors is carried externally of the end cap such that the Hall-effect sensor is provided in magnetically detectable association with the permanent magnet of the proximate moving member.

6. The apparatus of claim 1 wherein the first moving member comprises a compressor piston and the second moving member comprises a displacer, and wherein the housing further comprises a compression chamber interposed between the compressor piston and the displacer, and an expansion chamber communicating with the displacer opposite the compression chamber, a fluid flow path being formed by the compression chamber between the compressor piston and the displacer through which thermodynamic working gases pass therebetween.

7. The apparatus of claim 1 wherein each Hall-effect sensor comprises a temperature-compensated Hall-effect sensor.

8. The apparatus of claim 1 wherein the linear motor and the first moving member cooperate to form a compressor and the second moving member comprises a displacer, the compressor and the displacer cooperating to form a cryogenic cooler having an end cap provided in association with a cold space expansion chamber.

9. The apparatus of claim 8 further comprising a temperature sensor provided in heat transfer relation with the end cap, the control circuitry further being signal coupled with the temperature sensor and operative to regulate delivery of power from the power supply to the linear motor responsive to temperature detected by the temperature sensor proximate the end cap.

10. A cooler control system, comprising:

a housing encasing a compression chamber and an expansion chamber provided in fluid communication therebetween and configured to contain a thermodynamic working gas;

a compressor carried by the housing and having a linear motor and a piston, the piston supported for axial reciprocation in fluid communication with the compression chamber;

a displacer carried for axial reciprocation within the housing in fluid communication with the compression chamber at a first end and the expansion chamber at a second end, the displacer supported for movement in fluid communication with the piston via the thermodynamic working gas such that the displacer moves in axial reciprocation responsive to movement of the piston;

a magnet carried for movement within the housing in combination with at least one of the piston and the displacer;

a Hall-effect sensor carried by the housing in proximity with the magnet and operative to generate an output signal associated with displacement amplitude of the at least one of the piston and the displacer within the housing;

a power supply configured to deliver operating power to the compressor; and control circuitry coupled with the Hall-effect sensor and the power supply and configured to deliver operating power to the compressor responsive to the detected displacement amplitude of the at least one of the piston and the displacer.

11. The control system of claim 10 wherein the Hall-effect sensor is configured to detect stroke of the piston within the compression chamber so as to prevent overstroke.

12. The control system of claim 10 wherein the Hall-effect sensor is configured to detect stroke of the displacer within the housing so as to prevent overstroke.

13. The control system of claim 10 wherein a first magnet is affixed for movement with the piston and a second magnet is affixed for movement with the displacer, and wherein a first Hall-effect sensor is carried by the housing in association with the first magnet and a second Hall-effect sensor is carried by the housing in association with the second magnet, the control circuitry coupled with the first and the second Hall-effect sensors and configured to incrementally increase the operating power until one of the Hall-effect sensors detects overstroke of one of the piston and the displacer.

14. The control system of claim 10 wherein the control circuitry comprises a controller and a signal processor.

15. The control system of claim 10 wherein the power supply comprises a variable voltage power supply, the control circuitry operative to generate a variable voltage output signal to the power supply such that the power supply delivers a regulated output power to the linear motor of the compressor.

16. The control system of claim 10 wherein the linear motor comprises a shaft, moving laminations carried for movement on the shaft, and a plurality of stationary laminations encircling the moving laminations, wherein the piston is carried at a first end of the shaft and the magnet is carried at an opposite, second end of the shaft.

17. The control system of claim 16 wherein the linear motor further comprises a pair of flexure bearing assemblies configured to support the shaft, the moving laminations, the piston and the magnet for axial reciprocation within the housing.

18. The control system of claim 10 wherein the control circuitry comprises a timing chip configured to convert an output signal from the Hall-effect sensor from a relatively short duration pulse to a relatively long duration pulse.

19. The control system of claim 18 wherein the control circuitry further comprises an analog-to-digital (A/D) converter and a controller, the A/D converter operative to convert an analog signal from the timing chip into a digital signal that is received by the controller.

20. A Stirling cycle cryogenic cooler, comprising:

a compressor having a linear drive motor and a piston supported for reciprocation by the drive motor;

a displacer assembly having a displacer supported for reciprocation, the displacer cooperating with the compressor to contain a thermodynamic working gas;

a magnet carried for movement in combination with at least one of the piston and the displacer;

a Hall-effect sensor carried by one of the compressor and the displacer assembly in signal communication with the magnet and operative to generate an output signal indicative of displacement of the magnet;

a power supply usable to deliver operating power to the linear drive motor; and a controller signal coupled with the sensor and the power supply, configured to receive the output signal from the Hall-effect sensor and operative to regulate delivery of operating power to the power supply so as to regulate amplitude displacement of the at least one of the piston and the displacer.

21. The cooler of claim 20 wherein a first magnet is carried in combination with the piston and a second magnet is carried in combination with the displacer, and wherein a first Hall-effect sensor is carried by the compressor to detect movement of the piston and a second Hall-effect sensor is carried by the displacer assembly to detect movement of the displacer.

22. The cooler of claim 21 wherein the controller receives an output signal from each sensor, and delivers a control signal to the power supply responsive to receipt of one of the output signals.

23. The cooler of claim 21 further comprising a temperature sensor supported in heat transfer relation with a cold head of the displacer assembly, the controller configured in signal coupled relation with the temperature sensor and operative to regulate delivery of power from the power supply to the linear motor responsive to detected temperature at the cold head.

24. The cooler of claim 20 further comprising a housing formed between the compressor and the displacer assembly, configured to provide a compression chamber and an expansion chamber for containing a thermodynamic working gas, wherein the piston is carried for reciprocation in fluid communication with the compression chamber and the displacer is carried for reciprocation in fluid communication with the compression chamber at a first end and the expansion chamber at a second end.

25. The cooler of claim 22 wherein the housing includes an end cap formed at least in part from non-magnetic material, the Hall-effect sensor carried on an exterior of the end cap with the magnet carried for movement on an interior of the end cap such that the Hall-effect sensor detects movement of the magnet through the non-magnetic material of the end cap.

26. The cooler of claim 20 further comprising a housing having at least one chamber for containing a thermodynamic working gas, the Hall-effect sensor carried externally of the housing in magnetically detectable signal communication with the magnet.

27. The cooler of claim 20 further comprising a signal processor communicating with the sensor and the controller, and operative to condition the output signal from the Hall-effect sensor.

28. A method for adaptively controlling moving members within a closed cycle thermodynamic machine having at least two moving members that include a piston assembly and a displacer assembly that cooperate to contain a thermodynamic working gas, the piston assembly including a drive piston, and the displacer assembly including a displacer, wherein the drive piston and the displacer are supported for axial reciprocation within the machine and in communication with the working gas, comprising the steps of:

carrying a magnet for reciprocating movement with one of the drive piston and the displacer;

delivering operating power to the machine so as to impart reciprocation to the drive piston and the displacer;

detecting movement of the magnet with a Hall-effect sensor; and adjusting the level of operating power delivered to the machine in response to the detected movement of the magnet so as to control amplitude displacement of the one of the drive piston and the displacer.

29. The method of claim 28 wherein the closed cycle thermodynamic machine comprises a Stirling cycle cryogenic cooler, and wherein the piston assembly comprises a compressor having a linear motor, the step of adjusting the level of operating power comprising adjustably delivering operating power to the linear motor responsive to the detected position of the one of the drive piston and the displacer.

30. The method of claim 29 wherein the step of adjusting the level of operating power comprises incrementing the quantity of operating power delivered to the linear motor wherein an overstroke condition has not been detected by the Hall-effect sensor.

31. The method of claim 29 wherein the step of adjusting the level of operating power comprises decrementing the level of operating power delivered to the linear motor responsive to the detection of overstroke by the Hall-effect sensor.

32. The method of claim 28 wherein a magnet is carried for reciprocating movement with each of the drive piston and the displacer, and wherein the step of detecting displacement amplitude of the magnet with a Hall-effect sensor comprises monitoring the displacement amplitude of each of the drive piston and the displacer.

33. The method of claim 32 wherein the step of adjusting the level of operating power delivered to the machine comprises evaluating the detected displacement amplitude of the drive piston and the displacer to determine whether either of the drive piston and the displacement is in an overstroke condition, and decreasing the level of operating power delivered to the machine upon the detection of such an overstroke condition.

* * * * *

UNITED STATES PATENT AND TRADEMARK OFFICE

CERTIFICATE OF CORRECTION

PATENT NO. : 6,094,912
DATED : August 1, 2000
INVENTOR(S) : Ian Williford

It is certified that error appears in the above-identified patent and that said Letters Patent is hereby corrected as shown below:

Column 12,
Line 55, after the word "converts", delete 23.

Signed and Sealed this

Twenty-eighth Day of August, 2001

*Attest:*

Nicholas P. Godici

NICHOLAS P. GODICI
*Acting Director of the United States Patent and Trademark Office*

*Attesting Officer*